US006474785B1

(12) United States Patent
Koegler, III et al.

(10) Patent No.: US 6,474,785 B1
(45) Date of Patent: Nov. 5, 2002

(54) FLEXTENSIONAL TRANSDUCER AND METHOD FOR FABRICATION OF A FLEXTENSIONAL TRANSDUCER

(75) Inventors: John M. Koegler, III, Place Corvallis, OR (US); Timothy Beerling, Berkeley, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/655,495

(22) Filed: Sep. 5, 2000

(51) Int. Cl.[7] ..... B41J 2/04

(52) U.S. Cl. ..... 347/54

(58) Field of Search ..... 347/54, 68, 69, 347/70, 71, 72, 50, 40; 399/261; 361/700; 310/328–330; 29/890.1; 430/311

(56) References Cited

U.S. PATENT DOCUMENTS

| | | | |
|---|---|---|---|
| 4,533,082 | A | 8/1985 | Maehara et al. |
| 4,605,167 | A | 8/1986 | Maehara |
| 5,152,456 | A | 10/1992 | Ross et al. |
| 5,255,016 | A | 10/1993 | Usui et al. |
| 5,464,488 | A | 11/1995 | Servin |
| 5,513,431 | A | 5/1996 | Ohno et al. |
| 5,518,179 | A | 5/1996 | Humberstone et al. |
| 5,599,411 | A | 2/1997 | Schembri |
| 5,818,481 | A | 10/1998 | Hotomi et al. |
| 5,828,394 | A | 10/1998 | Khuri-Yakub et al. |
| 5,910,809 | A | 6/1999 | Usui et al. |
| 5,917,508 | A | 6/1999 | Lopez et al. |
| 5,947,364 | A | 9/1999 | Tamura et al. |
| 5,971,528 | A | 10/1999 | Yoshimura |
| 5,980,027 | A | 11/1999 | Yoshimura |
| 5,984,459 | A | 11/1999 | Takahashi et al. |
| 6,013,970 | A | 1/2000 | Nishiwaki et al. |
| 6,019,458 | A | 2/2000 | Shimada et al. |
| 6,049,046 | A | 4/2000 | Newland |
| 6,050,679 | A | 4/2000 | Howkins |
| 6,291,927 | B1 | 9/2001 | Percin et al. |

FOREIGN PATENT DOCUMENTS

| | | |
|---|---|---|
| EP | 0655334 A1 | 5/1995 |
| EP | 1075949 A2 | 2/2001 |
| WO | WO93/01404 | 1/1993 |
| WO | WO93/10910 | 6/1993 |
| WO | WO 93/10910 | 6/1993 |
| WO | WO 97/12689 | 4/1997 |
| WO | WO01/62394 A2 | 8/2001 |
| WO | WO01/62394 | 8/2001 |

OTHER PUBLICATIONS

Percin et al., Micromachined 2–D Array Piezoelectrically Actuated Flextensional Transducers: New Designs. Part of the SPIE Conference on Micromachined Devices and Components IV, Santa Clara, California, Sep. 1998; SPIE vol. 3514, pp. 411–414.

(List continued on next page.)

*Primary Examiner*—Raquel Yvette Gordon

(57) ABSTRACT

An apparatus and method of fabricating a flextensional transducer capable of ejecting a flowable material is disclosed. The method of fabricating a flextensional transducer capable of ejecting a flowable material includes ultrasonically metal welding an actuator body having an outer diameter and an aperture to a transducer membrane having an outer diameter and an aperture. The transducer membrane is also ultrasonically metal welded to a gland or nozzle capable of housing a portion of the flowable material. The gland or nozzle includes a surface adjacent to the transducer membrane having an aperture. The outer diameter of the actuator body is smaller than the aperture of the gland or nozzle.

35 Claims, 3 Drawing Sheets

OTHER PUBLICATIONS

Percin et al., Controlled Ink–Jet Printing and Deposition of Organic Polymers and Solid Particles. Applied Physics Letters, vol. 73, No. 16, Oct. 19, 1998, pp. 2375–2377.

Percin et al., Micromachined Two–Dimensional Array Piezoelectrically Actuated Transducers, Applied Physics Letters, vol. 72, No. 11, Mar. 16, 1998, pp. 1397–1399.

Percin et al., Micromachined 2–D Array Piezoelectrically Actuated Flextensional Transducers and Inkjet Print Heads. Electrochemical Society Proceedings vol. 98–14, pp. 87–93.

Percin et al., Resist Deposition without Spinning by Using Novel Inkjet Technology and Direct Lithography for MEMS. SPIE vol. 3333, pp. 1382–1389.

Percin, G., Micromachined Piezoelectrically Actuated Flextensional Transducers for High Resolution Printing and Medical Imaging, 1999, pp. 1–23.

Percin et al., Piezoelectrically Actuated Transducer and Droplet Ejector. 1996 IEEE Ultrasonics Symposium, pp. 913–916.

Percin et al., Piezoelectrically Actuated Droplet Ejector. Review of Scientific Instruments, vol. 68, No. 12, Dec. 1997, pp. 4561–4563.

Percin et al., Micromachined 2–D Array Piezoelectrically Actuated Flextensional Transducers. 1997 IEEE Ultrasonics Symposium, pp. 959–962.

FLEXTENSIONAL TRANSDUCER AND METHOD FOR FABRICATION OF A FLEXTENSIONAL TRANSDUCER

THE FIELD OF THE INVENTION

The present invention relates generally to drop-on-demand technology capable of ejecting droplets of a flowable material, and more specifically to a flextensional transducer utilizing an ultrasonic metal welding technique to bond components together such that no adhesive or epoxy materials are necessary.

BACKGROUND OF THE INVENTION

Inkjet printing is a technology that uses small drops of a flowable material, such as an ink droplet, to form an image on a medium. Two general types of inkjet printing technology exist, continuous flow technology and drop-on-demand technology. Continuous flow technology uses electrostatic acceleration and deflection to select ink drops from a continuous flow of ink to form an image. Drop-on-demand technology can be divided into two sub-categories, thermal inkjet technology and piezoelectric inkjet technology.

Thermal inkjet technology uses heat energy to vaporize a thin layer or bubble of ink which expels unvaporized ink above a resistive element and fires the ink through a nozzle. The physical components needed to implement thermal inkjet technology are embedded within an inkjet print cartridge. Conversely, piezoelectric inkjet technology includes an electromechanical means to eject a flowable material, such as an ink droplet. More specifically, an electrical signal is supplied to an orifice plate of a nozzle which forces a portion of the orifice plate to flex or contract into the nozzle, thereby causing an ejection of an ink droplet from the nozzle.

The frequency of a thermal inkjet printing device with which an ink droplet can be "fired" is limited by the thermal characteristics of a resistive element of the thermal inkjet printing device. For example, conventional thermal inkjet printers are capable of firing at a frequency in the range of 1–100 kilohertz. Conversely, conventional piezoelectric inkjet printing devices are capable of at firing a frequency in the range of 7,500–15,000 kilohertz, or up to approximately 15 times faster than conventional thermal inkjet printing devices.

Conventional piezoelectric inkjet technology utilizes an adhesive bond, such as a glue or an epoxy, to bond several components of a flextensional transducer relating to fire of an ink droplet. For example, a piezoelectric body or ring is bonded to a transducer membrane, which is in turn bonded to a nozzle or an orifice plate of a nozzle. An adhesive or epoxy bond forms each of these connections. The piezoelectric body, transducer membrane, and nozzle each include an aperture through which the ink droplets are fired. These apertures are formed by a drilling process.

Ink droplets used in conventional inkjet printers are made up of various chemicals, some of which are extremely caustic. These caustic chemicals have a tendency to attack the adhesive bond layers of conventional inkjet printers such that the adhesive bond layers dissolve and a mechanical malfunction occurs. The erosion of the adhesive layers prevents the inkjet printer from properly operating.

In addition to the erosion of adhesive layers due to the caustic chemicals discussed above, conventional inkjet technology utilizing an adhesive bond layer suffers from numerous disadvantages such as the adhesives or epoxies require time during the assembly for cure, the adhesives or epoxies require a precise deposition, the thickness of an adhesive layer varies, thereby varying the frequency response time, and the adhesives or epoxies are poor electrical conductors, thereby inhibiting the performance of the overall inkjet printer.

There is a need for a flextensional transducer which eliminates the use of adhesives or epoxies to bond together various components of the flextensional transducer. Therefore, the materials ejected from the flextensional transducer, regardless of its chemical composition, will not attack and destroy the bond between various components, rendering the overall device inoperable.

SUMMARY OF THE INVENTION

The present invention is a flextensional transducer apparatus and method of fabricating a flextensional transducer apparatus capable of ejecting a flowable material, such as a droplet of ink. The present invention includes ultrasonically metal welding various components of the flextensional transducer to securely interconnect the components of the flextensional transducer. Thus, no adhesives, glues, or epoxies are used.

The method of fabricating the flextensional transducer capable of ejecting a flowable material includes ultrasonically metal welding an actuator body having an outer diameter and an aperture to a transducer membrane having an outer diameter and aperture. The transducer membrane is also ultrasonically metal welded to a nozzle capable of housing a portion of the flowable material. The nozzle includes a surface adjacent to the transducer membrane having an aperture. The flowable material can be ejected through the apertures in each of the layers onto a media.

In one preferred embodiment, the aperture in one or more of the layers are laser ablated prior to any ultrasonic metal welding. In another preferred embodiment, a layer of an ultrasonic weldable metal material, such as a layer of gold, silver, or brass, is deposited onto one or more surfaces of the actuator body, the transducer membrane, or the nozzle, prior to the ultrasonic metal welding of the components to ensure a proper bond. In yet another preferred embodiment, the method of fabricating the flextensional transducer further includes electrically coupling a first electrical lead to the actuator body while electrically coupling a second electrical lead to the nozzle. Electrical circuitry is electrically coupled to the first and second electrical leads and is capable of providing an electrical signal to the flextensional transducer. In response to the electrical signal, the actuator body and the transducer membrane flexes or contracts towards the nozzle, thereby ejecting the flowable material. In still yet another preferred embodiment, the method of fabricating the flextensional transducer further includes fluidly coupling a reservoir of the flowable material to the nozzle.

The flextensional transducer apparatus of the present invention is capable of ejecting a flowable material. The flextensional transducer apparatus includes an actuator body having an outer diameter and an aperture. A transducer membrane is associated with the actuator body. The transducer membrane has an outer diameter and an aperture. A nozzle is associated with the transducer membrane. The nozzle is capable of housing a portion of the flowable material and includes a surface adjacent to the transducer membrane having an aperture.

In one preferred embodiment, the outer diameter of the actuator body is smaller than the aperture in the surface of the nozzle adjacent to the transducer membrane. In another preferred embodiment, the actuator body is a piezo-ceramic ring.

The flextensional transducer apparatus utilizes no adhesives, such as glue or epoxies, to interface the actuator body with the transducer membrane or to interface the transducer membrane with the nozzle. Rather, an ultrasonic metal welding procedure is used.

In yet another preferred embodiment, an ultrasonic weldable metal material layer is fabricated onto one or more surfaces of the actuator body, the transducer membrane, or the nozzle.

In still yet another preferred embodiment, the flextensional transducer apparatus further includes a first electrical lead electrically coupled to the actuator body and a second electrical lead electrically coupled to the nozzle. Electrical circuitry is electrically coupled to the first and second electrical leads capable of providing an electrical signal to the flextensional transducer apparatus causing the actuator body and the transducer membrane flex or contract towards the nozzle. In a further preferred embodiment, the flextensional transducer apparatus includes a flowable material reservoir capable of housing the flowable material in fluid communication with the nozzle.

The present flextensional transducer provides several advantages over conventional flextensional transducers used in piezoelectric inkjet technology. First, the present invention produces a permanent bond without a significant heating. Heating can weaken various layers of a conventional transducer. Second, the present invention provides interconnection points between components which do not become brittle. Third, the present invention provides interconnection of components which are corrosion resistant. Fourth, the present invention provides good electric connectivity between components. Fifth, the present invention requires no consumable materials, such as adhesives or epoxies. Sixth, the present invention requires no special environmental conditions, such as a helium atmosphere or a vacuum, in the fabrication process. Seventh, the present invention provides the laser ablation process for machine holes in one or more of the components which can be precisely controlled, as compared to traditional machining processes, such as drilling.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

The present invention includes an apparatus and method in which an ultrasonic metal welding process is utilized to bond various components of a flextensional transducer capable of ejecting a flowable material. Since no adhesives or glues are used to bond various components together, several negative attributes of conventional inkjet printing devices are minimized. For example, corrosion of adhesives leading to mechanical failure is alleviated. In addition, the manufacturing process is simplified in that no special conditions, such as a helium atmosphere or a vacuum, is required. Also, the electrical connection between various components is improved. Additionally, a permanent bond is produced with localized heating, which does not effect the robust quality of various components. In addition, no consumable materials, such as adhesives or epoxies, are required. Also, utilizing a laser ablation procedure provides a more accurate aperture in one or more of the components than a mechanical drilling procedure.

Figure 1:
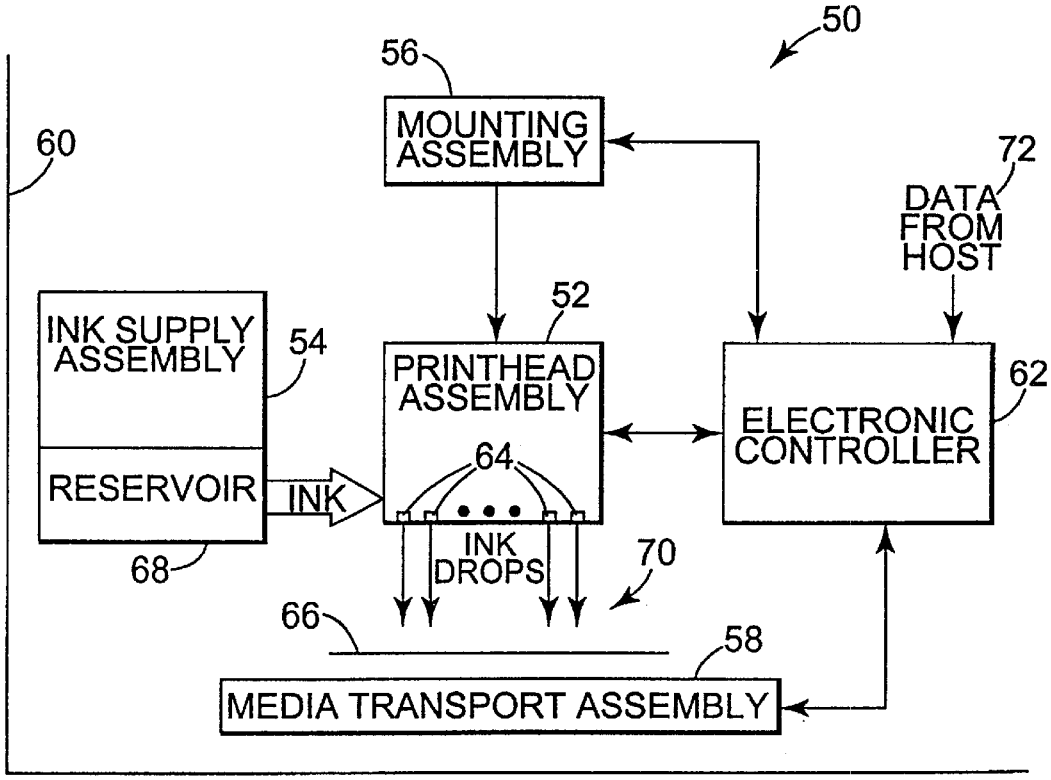
FIG. 1 is a block diagram of an inkjet printing system.

FIG. 1 is a block diagram illustrating printing system 50 including printhead assembly 52, ink supply assembly 54, mounting assembly 56, media transport assembly 58, housing 60, and electronic controller 62. Printhead assembly 52 includes one or more printheads having a plurality of flextensional transducers 64 which eject ink onto a media sheet 66. While the figures and following text discuss an apparatus and method of fabricating a flextensional transducer capable of ejecting a droplet of ink, it is understood that any flowable material, such as a liquid or flowable particles of a solid, may be ejected. The only constraint in this regard is that the material is capable of being ejected from the transducer.

Printhead assembly 52 receives ink from ink supply assembly 54. Ink supply assembly 54 includes reservoir 68 for storing a volume of ink. Ink supply assembly 54 and printhead assembly 52 form either a one way ink delivery system or a recirculating ink delivery system. For the re-circulating ink delivery system, ink flows from reservoir 68 into printhead assembly 52. Some of the ink travels into chambers within flextensional transducers 64, while other portions of ink return to ink reservoir 68.

In some embodiments, ink supply assembly 54 and printhead assembly 52 are housed together in a pen or cartridge. In other embodiments, ink supply assembly 54 is separate from printhead assembly 52 and feeds ink to printhead assembly 52 through an interface connection, such as a supply tube. For either approach, the ink supply may be removed, replaced, and/or refilled. For example, in an inkjet pen having an internal reservoir, the pen may be disassembled and the interior reservoir removed. A new, filled reservoir then is placed within the pen, and the pen reassembled for reuse. Alternatively, the prior reservoir may be refilled and reinstalled in the pen or filled in place without removing from the pen (and in some embodiments, without even disassembling the pen). In some embodiments, there is a local reservoir within the pen along with a larger reservoir located separate from the pen. The separate reservoir, such as reservoir 68 serves to refill the local reservoir. In various embodiments, reservoir 68 and/or the local reservoir as in printhead assembly 52 may be removed, replaced, and/or filled. Printhead assembly 52 is mounted relative to housing 60 to define a print zone 70 adjacent to flextensional transducers 64 in an area which is to receive media sheet 66. Media sheet 66 is moved into print zone 70 by media transport assembly 58. Mounting assembly 56 positions printhead assembly 52 relative to media transport assembly 58. For a scanning-type printhead assembly, mounting assembly 56 includes a carriage for moving printhead assembly 52 relative to a media transport path to scan printhead assembly 52 with respect to a media sheet. For a non-scanning type printhead assembly, mounting assembly 56 fixes printhead assembly 52 at a described positioned along the media transport path.

Electronic controller 62 receives documents, files, or other data 72 to be printed from a host system, such as a computer. Typically, a print job is sent to printing system 50 along an electronic, infrared, optical, or other information transfer path. The print job includes data and one or more commands or command parameters. Electronic controller 62 includes memory for temporarily storing the data. Electronic controller 62 provides timing control for firing flextensional transducers 64 to define a pattern of ejected ink drops which form characters, symbols, or other graphics on media sheet 66. The pattern is determined by the print job data and print job commands or command parameters.

Upon activation of a given flextensional transducer 64, ink within a nozzle of the flextensional transducer is ejected through a nozzle opening onto media sheet 66. Electronic controller 62 selects which flextensional transducer 64 are activated at a given time by activating corresponding drive signals. In one embodiment, logic circuitry and drive circuitry form a portion of controller 62. In an alternative embodiment, logic circuitry and drive circuitry are located within printhead assembly 52.

Figure 2:
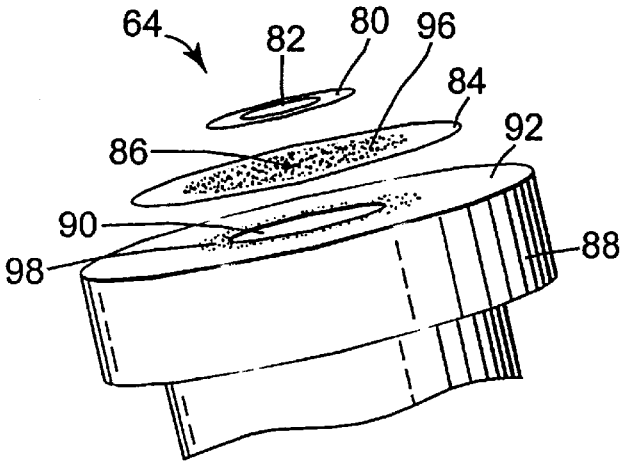
FIG. 2 is an exploded view of a portion of a flextensional transducer in accordance with the present invention.

FIG. 2 is an exploded, perspective view of a flextensional transducer, such as flextensional transducer 64, shown in FIG. 1. In accordance with the present invention, flextensional transducer 64 includes actuator body 80 having aperture 82, transducer membrane 84 having aperture 86, and nozzle 88 having aperture 90 within surface 92.

In one preferred embodiment, actuator body 80 is a piezo-ceramic material formed into a disc formation. Actuator body 80 preferably has a thickness in the range of approximately 0.5–5.0 mil, and an outer diameter in the range of approximately 0.10–0.30 inches and an inner diameter in the range of approximately 0.05 and 0.1 inches. Aperture 82 can be formed by standard mechanical drilling techniques known in the art, or by a laser ablation procedure. A laser ablation procedure has significantly more control and accuracy, as compared to a drilling procedure. Current laser technology is capable of producing an aperture within a piezo-ceramic ring having a thickness in the range discussed above.

Transducer membrane 84 can be formed from a variety of metal compositions, such as gold, silver, copper, brass, or stainless steel. In one preferred embodiment, transducer membrane 84 has a thickness in the range of approximately 1.0–5.0 mil, an outer diameter in the range of 3–10 inches, and an inner diameter in the range of 0.0006–0.050 inches. Similar to aperture 82, aperture 86 can be formed by standard mechanical drilling techniques or by a laser ablation procedure. Current laser technology is capable of producing an aperture within a metal composition having a thickness in the range discussed above. In one preferred embodiment, aperture 86 in transducer membrane 84 is smaller than aperture 82 in actuator body 80 and smaller than aperture 90 in nozzle 88.

Nozzle 88 includes a hollow cylinder from a top end to a bottom end of nozzle 88, wherein aperture 90 represents the cylinder at surface 92. Nozzle 88 is capable of holding or storing a portion of a flowable material. This flowable material may be any material capable of being ejected from nozzle 88 through apertures 90, 86, and 82. For example, the flowable material may be a liquid material, such as a droplet of ink. Conversely, the flowable material may be a particle solid, such as talcum powder.

While actuator body 80, transducer membrane 84, and nozzle 88 are shown to have specific configurations, these configurations should not be interpreted as a limitation. Rather, various configurations of actuator body 80 and transducer membrane 84 may be used without deviating from the present invention. For example, an elliptical configuration can be used. Similarly, any configuration of a nozzle or gland capable of housing a flowable material within a defined space may be utilized without deviating from the present invention.

As shown in FIG. 2, metal composition layers 96 and 98 are associated with transducer membrane 84 and nozzle 88, respectively. While it is not shown in FIG. 2, it is understood that similar metal composition layers can be associated with the bottom surface of actuator body 80 and the bottom surface of transducer membrane 84. During a fabrication process, once apertures 82, 86, and 90 have been formed, either by mechanically drilling or laser ablation, actuator body 80 is bonded to transducer membrane 84. Likewise, transducer membrane 84 is bonded to nozzle 88.

Flextensional transducer 64 does not incorporate any adhesive bonds, such as glues or epoxies, in order to secure the various components to each other. Rather, an ultrasonic metal welding procedure is undertaken which bonds actuator body 80 to transducer membrane 84 and transducer membrane 84 to nozzle 88 in a secure manner.

Ultrasonic metal welding is a technique in which two metal pieces or components are placed on top of each other and then are forced to move back and forth relative to each other at a frequency in the range of approximately 10–100 kilohertz, vibrating against each other until there is an atomic diffusion between the two pieces of metal, thereby creating a single interfused material. More particularly, ultrasonic welding of components is accomplished by creating high frequency vibrations from an ultrasonic welding horn which contacts a surface of the components being assembled. The vibration causes surface and intermolecular friction between the components which produces a sharp rise in temperature at the joints where the components meet. The rising temperature becomes great enough to then melt the metal causing a flow of metal between the components. After cessation of the vibration, the metal materials solidify and a weld results. The ultrasonic metal welding process is complete in the range of approximately 0.01–1.00 seconds. In one preferred embodiment, the process is completed in one-tenth of one second.

The ultrasonic metal welding process used in the present invention does not require a "clean" environment. Conventional procedures utilizing adhesives and epoxies require an environmentally controlled atmosphere, such as a vacuum. Conversely, ultrasonic metal welding does not require a clean atmosphere. Rather, the underlying requirements of an ultrasonic metal welding procedure provides a vibration process in which various oxide greases and related impurities are "scrubbed off". Thus, the fabrication of the flextensional transducer in accordance with the present inventions significantly reduces the manufacturing costs as compared to conventional flextensional transducers.

In one preferred embodiment, the metals used in the fabrication of actuator body 80, transducer membrane 84, and nozzle 88 to be ultrasonically metal welded together are "soft" metals, such as gold, copper, silver, or any other metal having similar strength characteristics. In another preferred embodiment, actuator body 80 is a piezoelectric component. In yet another preferred embodiment, actuator body 80 is a ceramic component. The fabrication of an additional layer of a soft metal actuator body 80, transducer membrane 84, and nozzle 88, regardless of whether one or more of these layers are formed from soft or non-soft metal layers, may enhance the ultrasonic metal welding process. If an additional layer of a soft metal is added to one or more components of flextensional transducer 64, the additional layer may have a thickness in the range of approximately 1–20 microns. In one preferred embodiment, the additional layer is 5 microns thick.

Figure 3:
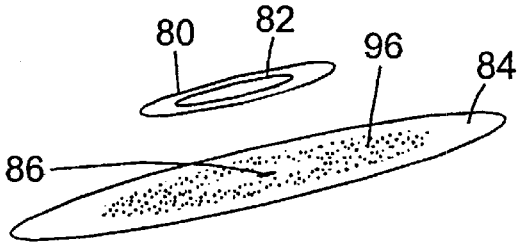
FIG. 3 is a perspective view illustrating an actuator body and a transducer membrane of a flextensional transducer in accordance with the present invention.
Figure 4:
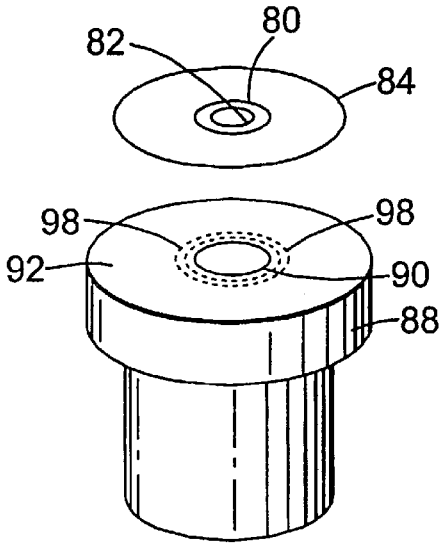
FIG. 4 is a perspective view of a flextensional transducer in accordance with the present invention prior to bonding the transducer member to the nozzle.

FIGS. 3 and 4 illustrate the ultrasonic metal welding fabrication technique previously discussed. As illustrated in FIG. 3, actuator body 80 is ultrasonically metal welded to transducer membrane 84. Depending upon the materials of actuator body 80 and transducer membrane 84, a layer of a soft metal, such as layer 96, may or may not be necessary. It is also understood that a layer of a soft metal may also be associated with the bottom surface of actuator body 80. Likewise, as shown in FIG. 4, a layer of a soft metal may be fabricated onto surface 92 of nozzle 88. A similar layer may also be fabricated onto the bottom surface of transducer membrane 84.

As shown in FIGS. 2–4, the outer diameter of actuator body 80 is smaller than the diameter of aperture 90 in nozzle 88. As will later be discussed, an electrical signal supplied to flextensional transducer 64 causes actuator body 80 to shrink, thus bonding transducer membrane 84 toward nozzle 88. In other words, the electrical signal causes actuator body 80 and a portion of transducer membrane 84 to flex or contract inward toward nozzle 88. This contraction forces a flowable material to be ejected from flextensional transducer 64, and more specifically from nozzle 88. If the outer diameter of actuator body 80 is larger than aperture 90 of nozzle 88, the proper amount of torque necessary to flex or contract actuator body 80 and transducer member 84 into nozzle 88 will be lacking and a proper ejection will not occur.

Figure 5:
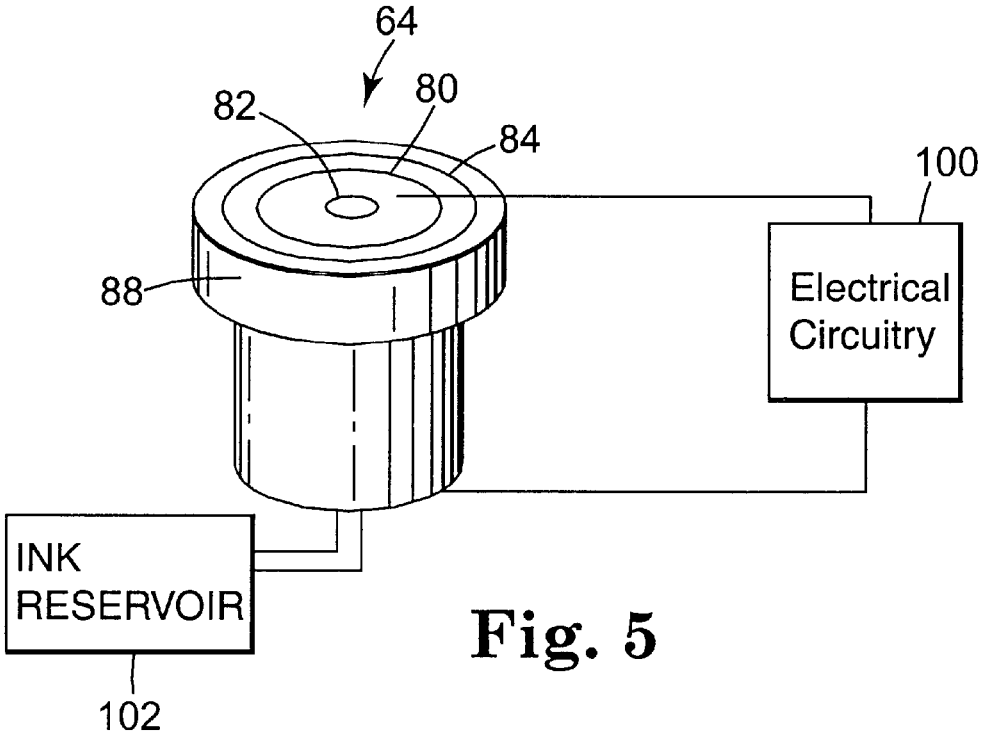
FIG. 5 is a perspective view of a flextensional transducer in a non-firing state in accordance with the present invention.

FIG. 5 illustrates flextensional transducer 64 in electrical connection with electrical circuitry 100 and in fluid communication with ink reservoir 102. Ink reservoir 102 is similar to ink reservoir 68, shown in FIG. 1. Ink reservoir 102 stores a volume of a flowable material capable of being ejected from flextensional transducer 64. A flowable material is provided between ink reservoir 102 and flextensional transducer 64 via fluid connection 104.

Electrical circuitry is electrically coupled to flextensional transducer 64 via electrical leads 106 and 108. Electrical lead 106 is electrically connected to actuator body 80, while electrical lead 108 is electrically connected to nozzle 88. In one preferred embodiment, electrical leads 106 and 108 are bonded to actuator body 80 and nozzle 88, respectively, via the ultrasonic metal welding technique previously discussed. Electrical leads 106 and 108 are formed from any electrically conducting metal material, such as copper, silver, or gold. Electrical circuitry 100 provides an electrical signal to flextensional transducer 64 which causes actuator body 80, transducer membrane 84, and surface 92 of nozzle 88 to flex or contract inward towards nozzle 88. Electrical circuitry 100 is controlled by data 72 (shown and described with respect to FIG. 1) from a host via electronic controller 62 (shown and described with respect to FIG. 1).

Figure 6:
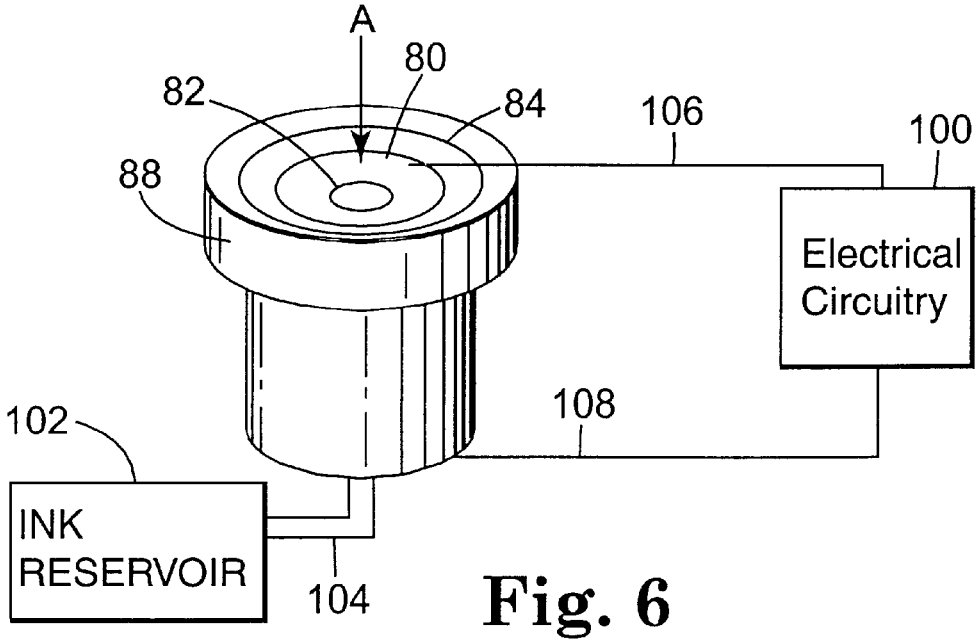
FIG. 6 is a perspective view of a flextensional transducer in a firing state in accordance with the present invention.

FIG. 6 is a perspective view of flextensional transducer 64 in a firing state in accordance with the present invention. As previously discussed, electrical circuitry 100 provides an electrical signal to flextensional transducer 64 which causes actuator body 80 to shrink or contract in the direction of arrow A. This shrinking or contraction of actuator body 80 in the direction of arrow A causes a portion of transducer membrane 84 to flex or contract in the direction of arrow A, thereby ejecting a portion of a flowable material. In one preferred embodiment, the flowable material is a droplet of ink which is fired onto a media, such as a piece of paper or a roller which subsequently transmits the ink droplet onto the piece of paper. In another preferred embodiment, the flowable material is a particulate solid, such as talcum powder or a chalk substance.

To summarize, the present invention includes an apparatus and method in which an ultrasonic metal welding process is utilized to bond various components of a flextensional transducer capable of ejecting a flowable material. Since no adhesives or glues are used to bond various components together, several negative attributes of conventional inkjet printing devices are minimized. For example, corrosion of adhesives leading to mechanical failure is alleviated. In addition, the manufacturing process is simplified in that no special conditions, such as a helium atmosphere or a vacuum is required. Also, electrical connection between various components have improved. Additionally, a permanent bond is produced with localized heating, which does not effect the robust quality of various components. In addition, no consumable materials, such as adhesives or epoxies is required. Also, utilizing a laser ablation procedure to produce apertures in various components provides a more accurate aperture than a mechanical drilling procedure.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A method of fabricating a flextensional transducer capable of ejecting a flowable material, the method comprising:

ultrasonically metal welding an actuator body having an aperture to a transducer membrane having an aperture; and bonding the transducer membrane to a nozzle capable of housing a portion of the flowable material, the nozzle including a surface adjacent to the transducer membrane having an aperture.

2. The method of claim 1, wherein the step of bonding the transducer membrane to the nozzle further comprises:

ultrasonically metal welding the transducer membrane to a nozzle capable of housing a portion of the flowable material.

3. The method of claim 1, and further comprising:

depositing a layer of an ultrasonic weldable metal material onto a surface of the actuator body associated with the transducer membrane.

4. The method of claim 1, and further comprising:

depositing a layer of an ultrasonic weldable metal material onto a surface of the transducer membrane associated with the actuator body.

5. The method of claim 1, and further comprising:

electrically coupling a first electrical lead to the actuator body;

electrically coupling a second electrical lead to the nozzle;

electrically coupling circuitry to the first and second electrical leads capable of providing an electrical signal to the flextensional transducer such that the actuator body and the transducer membrane contract towards the nozzle, thereby ejecting the flowable material.

6. The method of claim 5, wherein the steps of electrically coupling the first lead to the actuator body and electrical coupling the second lead to the nozzle further comprises:

ultrasonically metal welding the first electrical lead to the actuator body; and ultrasonically metal welding the second electrical lead to the nozzle.

7. The method of claim 1, and further comprising: fluidly coupling a reservoir of the flowable material to the nozzle.

8. The method of claim 1, and further comprising:

laser ablating the aperture in the transducer membrane.

9. A method of fabricating a flextensional transducer capable of ejecting a flowable material, the method comprising:

bonding an actuator body having an aperture to a transducer membrane having an aperture; and ultrasonically metal welding the transducer membrane to a nozzle capable of housing a portion of the flowable material, the nozzle including a surface adjacent to the transducer membrane having an aperture.

10. The method of claim 9, wherein the step of bonding the actuator body to the transducer membrane further comprises:

ultrasonically metal welding the actuator body to the transducer membrane.

11. The method of claim 9, and further comprising:

depositing a layer of an ultrasonic weldable metal material onto a surface of the transducer membrane associated with the nozzle.

12. The method of claim 9, and further comprising:

depositing a layer of an ultrasonic weldable metal material onto a surface of the nozzle associated with the transducer membrane.

13. The method of claim 9, and further comprising:

electrically coupling a first electrical lead to the actuator body;

electrically coupling a second electrical lead to the nozzle;

electrically coupling circuitry to the first and second electrical leads capable of providing an electrical signal to the flextensional transducer such that the actuator body and the transducer membrane contract towards the nozzle, thereby ejecting the flowable material.

14. The method of claim 9, wherein the steps of electrically coupling the first lead to the actuator body and electrical coupling the second lead to the nozzle further comprises:

ultrasonically metal welding the first electrical lead to the actuator body; and ultrasonically metal welding the second electrical lead to the nozzle.

15. The method of claim 9, and further comprising: fluidly coupling a reservoir of the flowable material to the nozzle.

16. The method of claim 9, and further comprising:

laser ablating the aperture in the transducer membrane.

17. A flextensional transducer apparatus capable of ejecting a flowable material, the flextensional transducer apparatus comprising:

an actuator body having an aperture;

a transducer membrane ultrasonically metal welded to the actuator body, the transducer membrane having an aperture; and a nozzle associated with the transducer membrane such that the transducer membrane is positioned between the actuator body and the nozzle, the nozzle capable of housing a portion of the flowable material and including a surface adjacent to the transducer membrane having an aperture, wherein the flowable material is capable of being ejected through the apertures of the nozzle, the transducer membrane, and the actuator body.

18. The flextensional transducer apparatus of claim 17, and further comprising:

a first electrical lead electrically coupled to the actuator body;

a second electrical lead electrically coupled to the nozzle;

electrical circuitry electrically coupled to the first and second electrical leads capable of providing an electrical signal to the flextensional transducer apparatus such that the actuator body and the transducer membrane contract towards the nozzle.

19. The flextensional transducer apparatus of claim 17, and further comprising:

a flowable material reservoir capable of housing the flowable material in fluid communication with the nozzle.

20. The flextensional transducer apparatus of claim 17, wherein an outer diameter of the actuator body is smaller than the aperture in the surface of the nozzle adjacent to the transducer membrane.

21. The flextensional transducer apparatus of claim 17, wherein the aperture in the transducer membrane is smaller than the aperture in the nozzle and smaller than the aperture in the actuator body.

22. The flextensional transducer apparatus of claim 17, wherein no adhesives are utilized to interface the actuator body with the transducer membrane.

23. The flextensional transducer apparatus of claim 17, wherein the actuator body is a piezo-ceramic ring.

24. The flextensional transducer apparatus of claim 17, and further comprising:

an ultrasonic weldable metal material layer fabricated onto a surface of the actuator body associated with the transducer membrane.

25. The flextensional transducer apparatus of claim 17, and further comprising:

an ultrasonic weldable metal material layer fabricated onto a surface of the transducer membrane associated with the actuator body.

26. A flextensional transducer apparatus capable of ejecting a flowable material, the flextensional transducer apparatus comprising:

an actuator body having an aperture;

a transducer membrane associated with the actuator body, the transducer membrane having an aperture; and a nozzle ultrasonically metal welded to the transducer membrane such that the transducer membrane is positioned between the actuator body and the nozzle, the nozzle capable of housing a portion of the flowable material and including a surface adjacent to the transducer membrane having an aperture, wherein the flowable material is capable of being ejected through the apertures of the nozzle, the transducer membrane, and the actuator body.

27. The flextensional transducer apparatus of claim 26, and further comprising:

a first electrical lead electrically coupled to the actuator body;

a second electrical lead electrically coupled to the nozzle;

electrical circuitry electrically coupled to the first and second electrical leads capable of providing an electrical signal to the flextensional transducer apparatus such that the actuator body and the transducer membrane contract towards the nozzle.

28. The flextensional transducer apparatus of claim 26, and further comprising:

a flowable material reservoir capable of housing the flowable material in fluid communication with the nozzle.

29. The flextensional transducer apparatus of claim 26, wherein an outer diameter of the actuator body is smaller than the aperture in the surface of the nozzle adjacent to the transducer membrane.

30. The flextensional transducer apparatus of claim 26, wherein the aperture in the transducer membrane is smaller than the aperture in the nozzle and smaller than the aperture in the actuator body.

31. The flextensional transducer apparatus of claim 26, wherein no adhesives are utilized to interface the transducer membrane with the nozzle.

32. The flextensional transducer apparatus of claim 26, wherein the actuator body is a piezo-ceramic ring.

33. The flextensional transducer apparatus of claim 26, and further comprising:

an ultrasonic weldable metal material layer fabricated onto a surface of the transducer membrane associated with the nozzle.

34. The flextensional transducer apparatus of claim 26, and further comprising:

an ultrasonic weldable metal material layer fabricated on a surface of the nozzle associated with the transducer membrane.

35. An inkjet printing device capable of ejecting a flowable material, the inkjet printing device comprising:

an actuator body having an aperture;

a transducer membrane ultrasonically metal welded to the actuator body, the transducer membrane having an aperture; and a nozzle ultrasonically metal welded to the transducer membrane such that the transducer membrane is positioned between the actuator body and the nozzle, the nozzle capable of housing a portion of the flowable material and including a surface adjacent to the transducer membrane having an aperture, wherein the flowable material is capable of being ejected through the apertures of the nozzle, the transducer membrane, and the actuator body.

* * * * *